US007822361B2

(12) United States Patent
Ishino

(10) Patent No.: US 7,822,361 B2
(45) Date of Patent: Oct. 26, 2010

(54) IMAGE FORMING APPARATUS HAVING TWO FIXING DEVICES WITH SHEET-PATHS OF DIFFERING LENGTHS

(75) Inventor: Masahiro Ishino, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 11/867,718

(22) Filed: Oct. 5, 2007

(65) Prior Publication Data

US 2008/0232868 A1 Sep. 25, 2008

(30) Foreign Application Priority Data

Feb. 1, 2007 (JP) ..... 2007-022986

(51) Int. Cl.
*G03G 15/20* (2006.01)

(52) U.S. Cl. ..... 399/122; 399/322

(58) Field of Classification Search ..... 399/107, 399/110, 122, 320–341
See application file for complete search history.

(56) References Cited

FOREIGN PATENT DOCUMENTS

JP 2004-109905 A 4/2004

*Primary Examiner*—David M Gray
*Assistant Examiner*—Ruth N Labombard
(74) *Attorney, Agent, or Firm*—Sughrue Mion, PLLC

(57) ABSTRACT

An image forming apparatus includes: an apparatus body; an image forming unit; a first fixing device; and a second fixing device, the first and second fixing device being selectively attached, and the apparatus body including: a first attaching region that is formed by detaching the first fixing device; a sheet-discharging region in which, in a case where the first fixing device is attached to the apparatus body, a sheet subjected to a fixing operation by the first fixing device is discharged into an upper portion of the apparatus body while downwardly directing a face on which the fixing operation is performed; and a second attaching region to which the second fixing device is attached, and that includes the first attaching region and the sheet-discharging region.

7 Claims, 9 Drawing Sheets

IMAGE FORMING APPARATUS HAVING TWO FIXING DEVICES WITH SHEET-PATHS OF DIFFERING LENGTHS

CROSS-REFERENCE TO RELATED APPLICATIONS

This application is based on and claims priority under 35 U.S.C. 119 from Japanese Patent Application No. 2007-022986 filed Feb. 1, 2007.

BACKGROUND

1. Technical Field

The present invention relates to an image forming apparatus and a fixing unit.

2. Related Art

Because of recent improvements such as digitization, high definition, and the like, an image of high quality can be obtained in a color image forming apparatus. In accordance with the enhancement of image quality, attempts of launching a color image forming apparatus of the electrophotographic system in the print and photo markets have been made.

SUMMARY

It is an object of the invention to provide an image forming apparatus in which, even when a configuration of enabling an output of an image of high quality is employed, the installation area is not increased.

According to an aspect of the present invention, an image forming apparatus including: an apparatus body; an image forming unit that forms a toner image, and that transfers the toner image to a sheet; a first fixing device that fixes the toner image transferred to the sheet by the image forming unit; and a second fixing device that has a sheet-path length being longer than the first fixing device, and that outputs an image of a higher quality than produced by the first fixing device, the first and second fixing device being selectively attached, and the apparatus body including: a first attaching region that is formed by detaching the first fixing device; a sheet-discharging region in which, in a case where the first fixing device is attached to the apparatus body, a sheet subjected to a fixing operation by the first fixing device is discharged while downwardly directing a face on which the fixing operation is performed, and that is positioned in an upper portion of the apparatus body; and a second attaching region to which the second fixing device is attached, and that includes the first attaching region and the sheet-discharging region.

BRIEF DESCRIPTION OF THE DRAWINGS

Exemplary embodiment of the present invention will be described in detail based on the following figures, wherein:

FIGS. 1A and 1B are views illustrating relationships between a body of an image forming apparatus to which an embodiment is applied, and fixing devices which are detachably attached to the body, in which FIG. 1A is a view in the case where one of the fixing devices is attached, and FIG. 1B is a view in the case where the other fixing device is attached;

DETAILED DESCRIPTION

Hereinafter, an embodiment which is an example of the invention will be described with reference to the accompanying drawings.

Figure 1A:
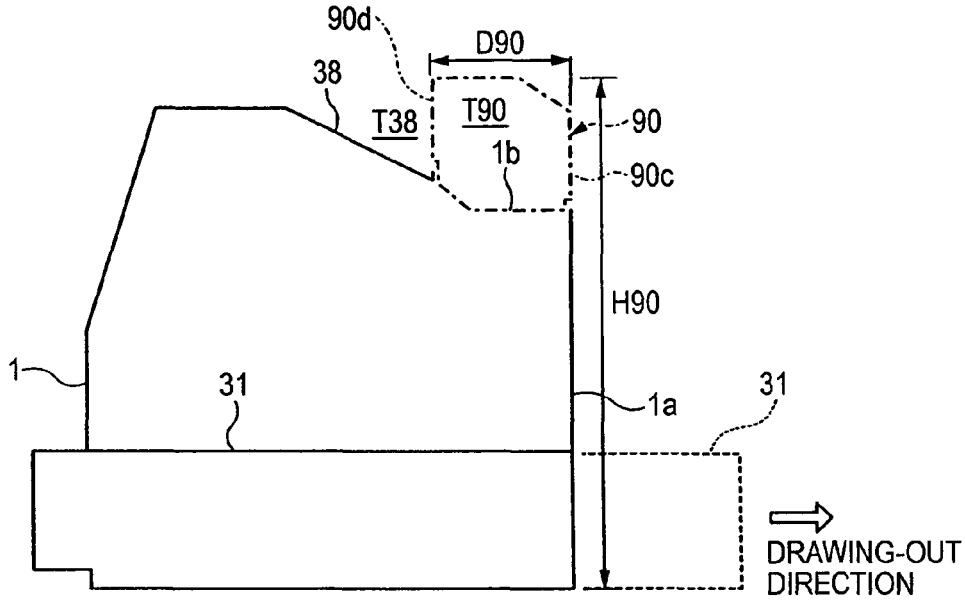
Figure 1B:
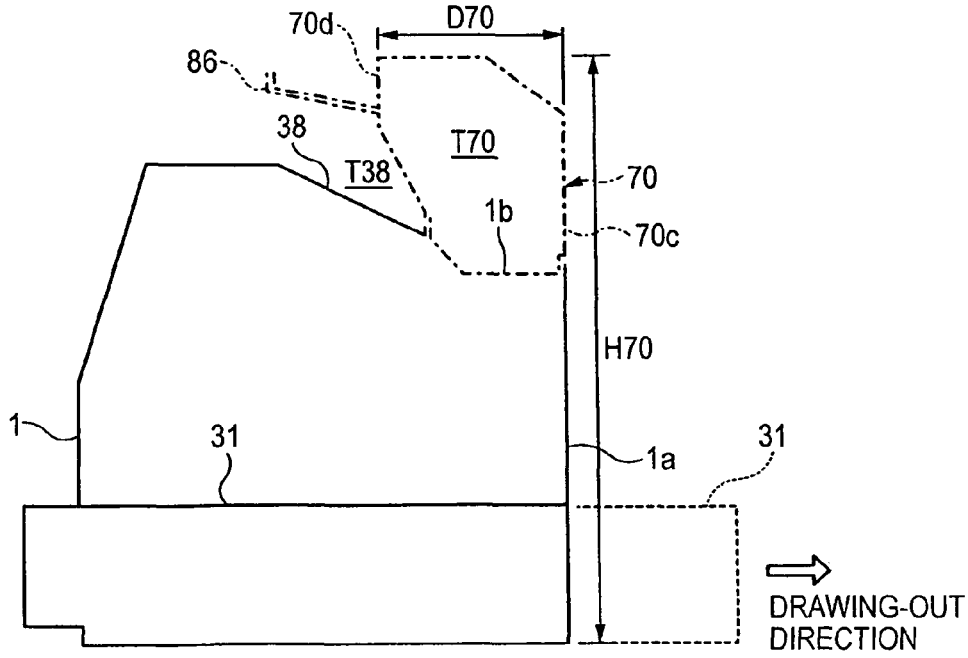

FIG. 1 is a view illustrating relationships between a body 1 of an image forming apparatus to which the embodiment is applied, and fixing devices (fixing units) 90, 70 which are detachably attached to the body 1, in which FIG. 1A is a view in the case where the fixing device (first fixing device) 90 is attached, and FIG. 1B is a view in the case where the fixing device (second fixing device) 70 is attached.

As shown in FIG. 1A, the image forming apparatus is configured so that the fixing device 90 can be attached to the body 1, and, as shown in FIG. 1B, the fixing device 70 can be attached to the body in place of the fixing device 90. In other words, the fixing device 70 and the fixing device 90 can be selectively attached to the body 1 of the image forming apparatus. More specifically, in the case where the fixing device 90 is attached to the body 1 (see FIG. 1A), the fixing device 90 can be replaced with the fixing device 70, and, in the case where the fixing device 70 is attached to the body 1 (see FIG. 1B), the fixing device 70 can be replaced with the fixing device 90. Such replacement may be performed in the market after the fixing device 90 or 70 is sent to the customer or the salesperson, or, in accordance with the order, in a stage before shipment from the factory or a warehouse.

When the fixing device 90 or 70 is attached to the body 1 of the image forming apparatus, a controlling portion 40 (see FIG. 2) which will be described later can detect which of the fixing devices 90, 70 is attached.

Although described later in detail, the quality of an image output in the case where the fixing device 70 is used is higher than that of an image output in the case where the fixing device 90 is used. Namely, the fixing devices 90, 70 are different from each other in fixing system, and due to this the sizes of the fixing devices 90, 70 are different from each other.

An attaching portion 1*b* of the body 1 to which the fixing devices 90, 70 are attached is positioned on the side of a side wall (outer side face) 1*a* of the body 1. Namely, the attaching portion 1*b* is positioned on the side of the body 1 from which a sheet-supply cassette (housing portion) 31 is to be drawn out. Additionally speaking, in the attaching portion 1*b*, the fixing devices 90, 70 are not required to be positioned in the strictly same position, and may be positioned in different positions depending on the external shapes of the fixing devices 90, 70.

Figure 2:
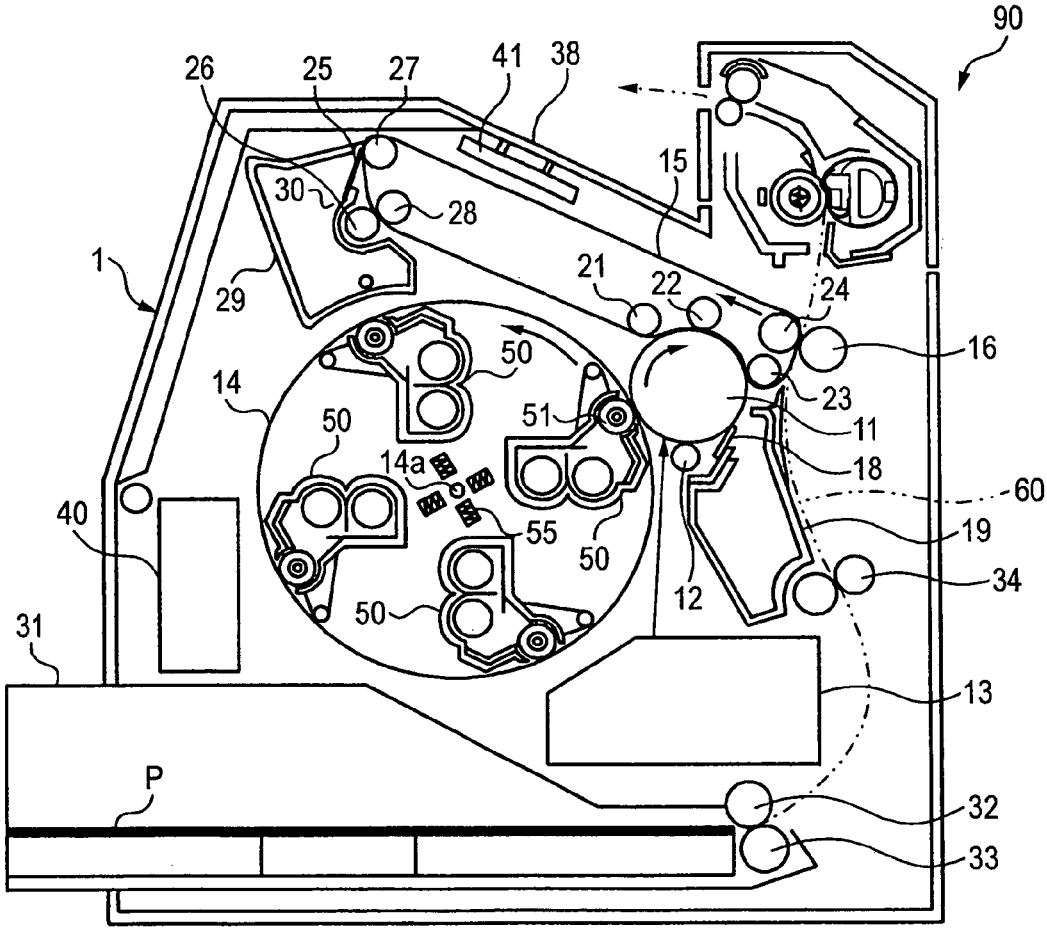
FIG. 2 is a view showing a state where the fixing device is attached to the body of the image forming apparatus.

The side wall 1*a* is the outer side face of the body 1 on the side of a portion which is drawn out when the user wishes to replenish the sheet-supply cassette (housing portion) 31 with sheets (fixing object) P (see FIG. 2). The sheet-supply cassette 31 is used for housing sheets P to be conveyed to an image forming portion which will be described later.

When the fixing device 90 or 70 is attached to the body 1, an outer face 90*c* of the fixing device 90, or an outer face 70*c* of the fixing device 70 constitutes a part of the side wall 1*a*. In other words, a part of the side wall of the image forming apparatus is configured by the outer face 90*c* or 70*c* of the fixing device 90 or 70.

The positional relationship between the side wall 1*a* of the body 1 and the outer face 70*c* of the fixing device 70 is identical with that between the side wall 1*a* of the body 1 and the outer face 90*c* of the fixing device 90. Namely, the position of the outer face 70*c* in the case where the fixing device 70 is attached to the attaching portion 1*b* of the body 1 is identical with that of the outer face 90*c* in the case where the fixing device 90 is attached to the attaching portion 1 of the body 1. In the case where the fixing device 90 is attached to the attaching portion 1*b* of the body 1, therefore, the fixing device does not protrude toward the side wall 1*a* as compared with the case where the fixing device 70 is attached.

On the other hand, the height of the fixing device 70 is larger than that of the fixing device 90. Therefore, the height $H_{70}$ in the case where the fixing device 70 is attached to the body 1 is larger than the height $H_{90}$ in the case where the fixing device 90 is attached to the body 1 ($H_{70}>H_{90}$).

The depth of the fixing device 70 is larger than that of the fixing device 90. As shown in FIG. 1, namely, the depth $D_{70}$ of the fixing device 70 is larger than the depth $D_{90}$ of the fixing device 90 ($D_{70}>D_{90}$) The relative positional relationship between a discharge tray 38 and the fixing device in the case where the fixing device 90 is attached to the body 1 is different from that between the discharge tray 38 and the fixing device in the case where the fixing device 70 is attached to the body 1. Specifically, in the case where the fixing device 70 is attached to the body 1, an outer face 70*d* of the fixing device 70 is located in a position more advanced toward the sheet discharge direction (the left side of the figure) than an outer face 90*d* of the fixing device 90 in the case where the fixing device 90 is attached to the body 1. The outer face 90*d* of the fixing device 90 is the face which is positioned on the side of the discharge tray 38 in the case where attached to the body 1, and the outer face 70*d* of the fixing device 70 is the face which is positioned on the side of the discharge tray 38 in the case where attached to the body 1.

As described above, the fixing device 70 is attached to the body 1 so as to occupy a region (second attaching region) $T_{70}$ configured by: a region (first attaching region) $T_{90}$ which is formed by detaching the fixing device 90 from the body 1; and a part of a region (sheet discharging portion, sheet-discharging region) $T_{38}$ in which, when the fixing device 90 is attached to the body 1, the sheet P that is subjected to the fixing operation by the fixing device 90 is discharged ($T_{70}=T_{90}+T_{38}$). In other words, the fixing device 70 is attached to the body 1 so as to occupy the region $T_{90}$ and at least a part of the region $T_{38}$, in place of the fixing device 90. Therefore, the installation area of the image forming apparatus in the case where the fixing device 70 is attached is equivalent to that of the image forming apparatus in the case where the fixing device 90 is attached.

(In the Case where the Fixing Device 90 is Attached to the Body 1)

Next, the configuration shown in FIG. 1A) will be described. FIG. 2 is a view showing a state where the fixing device 90 is attached to the body 1 of the image forming apparatus, and illustrating a digital color printer using a rotary developing device.

In the image forming apparatus shown in FIG. 2, the body 1 comprises as the image forming portion: a photosensitive drum 11 serving as an image carrier which forms an electrostatic latent image and carries a toner image; a charging device 12 which uses a charging roll and the like to give charges to the photosensitive drum 11, thereby charging the drum; an exposing device 13 which exposes the charged photosensitive drum 11 on the basis of an image signal from an image processing apparatus (not shown); and a developing device 14 which develops the electrostatic latent image formed on the photosensitive drum 11 by the exposing device 13, thereby forming a toner image.

The developing device 14 is a rotary developing device In order to form toner images of four colors of yellow (Y), magenta (M), cyan (C), and black (K), the device comprises four developing units 50 respectively containing toners of the colors. Developing rolls 51 which develop the photosensitive drum 11 are disposed on the circumference of the developing device 14. The developing device 14 is rotated in steps of 90 degrees about the developing device center 14*a*, so that the developing roll 51 of a desired one of the developing units 50 is opposed to the photosensitive drum 11. Specifically, in one print out, the developing units 50 of Y, M, C, and K are sequentially opposed in this order to the photosensitive drum 11 thereby enabling a full color image to be output. Each of the developing units 50 is pressed in the normal line by a coil spring 55 placed on the developing device center 14*a*, thereby enabling a tracking roll 52 (see FIG. 3) for positioning to surely butt against the photosensitive drum 11. The photosensitive drum 11 is rotated in the direction (clockwise direction) of the arrow in the figure, and the developing device 14 is rotated in a counterclockwise direction, so that the movement in the tangential direction is identical with the rotation (clockwise direction) of the photosensitive drum 11.

In the downstream of the developing device 14 on the photosensitive drum 11, an intermediate transferring belt 15 which temporarily holds the toner images that are developed by the developing units 50 to be formed on the photosensitive drum 11, a secondary transferring roll 16 which transfers the toner images that are superimposedly formed on the intermediate transferring belt 15, to the sheet P, and the fixing device (first fixing device) 90 which fixes the toner images formed on the sheet P by means of heating and pressurizing are disposed.

In the periphery of the photosensitive drum 11, a cleaning blade 18 which scrapes off a toner (residual toner) remaining on the photosensitive drum 11 after the primary transfer to the intermediate transferring belt 15, and a toner recovery bottle 19 which recovers and collects the toner scraped off by the cleaning blade 18 are disposed. When one print image is to be formed, the intermediate transferring belt 15 makes four rotations. In the initial three rotations, i.e., when the toner images of Y, M, and C are held, the secondary transferring roll 16 is separated from the intermediate transferring belt 15. When the final toner image of K is to be superimposed, the secondary transferring roll is in contact with the intermediate transferring belt 15.

The intermediate transferring belt 15 contacts with (butts against) the photosensitive drum 11 in a wrapping manner so as to be wound the drum in a predetermined range, thereby enabling the so-called wrapping transfer. For example, the intermediate transferring belt 15 has a thickness of about 0.5 mm and a circumference length of 443 mm, and is made of chloroprene which has excellent oil resistance and weather resistance, EPDM which has excellent weather resistance, or the like. In the embodiment, the intermediate transferring belt 15 itself has no driving source, and is configured so that it is driven by the rotation of the photosensitive drum 11 with using the contact due to the wrapping. The intermediate transferring belt is rotated in a counterclockwise direction, so that the rotation direction in the contact portion coincides with that of the drum.

Inside the intermediate transferring belt 15, a wrap-in roll 21 which specifies the wrapping position of the intermediate transferring belt 15 in the upstream side of the rotation of the photosensitive drum 11 a primary transferring roll 22 which transfers the toner images formed on the photosensitive drum 11 to the intermediate transferring belt 15, and a wrap-out roll 23 which specifies the wrapping position of the intermediate transferring belt 15 in the downstream side of the wrapping position are disposed. A predetermined electric field for assisting the primary transfer is applied to the primary transferring roll 22. The wrap-in roll 21 and the wrap-out roll 23 are set to the GND or floating state.

A backup roll 24 which assists the secondary transfer of the secondary transferring roll 16 is disposed inside the intermediate transferring belt 15. In a secondary transfer station where the secondary transfer is performed by the secondary transferring roll 16 and the backup roll 24, a predetermined potential difference is necessary between the backup roll 24 and the secondary transferring roll 16. When the secondary transferring roll 16 is connected to a higher potential, for example, the opposing other roll, or the backup roll 24 is connected to the GND.

On the downstream side of the secondary transfer station on the intermediate transferring belt 15, an intermediate-transferring member cleaner 30 which removes away toners on the intermediate transferring belt 15 after the secondary transfer is disposed. The intermediate-transferring member cleaner 30 comprises: a scraper 25 which scrapes off a toner remaining after the secondary transfer; a brush roll 26 which further scrapes off a toner remaining after the cleaning by the scraper 25; and a second toner recovery bottle 29 which recovers the toner scraped off by the scraper 25 and the brush roll 26. Inside the intermediate transferring belt 15, a cleaning backup roll 27 which assists the cleaning work by the scraper 25, and a cleaning backup roll 28 which assists the cleaning work by the brush roll 26 are disposed.

The scraper 25 is configured by a thin plate of stainless steel or the like having a thickness of about 0.1 mm. A predetermined electric field is applied to the scraper. The brush roll 26 is a brush made of nylon, acrylic resin, or the like which has undergone a conducting process, and receives a power from a driving source to be rotated. The scraped-off toner is accommodated into the second toner recovery bottle 29 through a window disposed in the second toner recovery bottle 29. The scraper 25 and the brush roll 26 scrape off a residual toner on the intermediate transferring belt 15 after the secondary transferring roll 16 is contacted with the intermediate transferring belt 15 to perform the secondary transfer. Therefore, the scraper 25 and the brush roll 26 are configured so that, in an initial stage of the image formation, they are separated from the intermediate transferring belt 15 so as not to scrape off the toner images which are in the course of the superimposing process, and, at a given timing, they are contacted in an integral manner with the intermediate transferring belt 15.

In the embodiment, as shown in FIG. 2, it is laid out so that the intermediate transferring belt 15 extends in a relatively thin shape. The intermediate transferring belt 15 is flatly supported by the wrap-in roll 21, the wrap-out roll 23, the backup roll 24, the cleaning backup roll 27, the cleaning backup roll 28, and the like. At one end in the longitudinal direction of the intermediate transferring belt 15 which is flatly supported, the secondary transfer station against which the secondary transferring roll 16 butts is disposed, and, at the other end in the longitudinal direction, the intermediate-transferring member cleaner 30 is disposed. The secondary transfer station against which the secondary transferring roll 16 butts is disposed is in the vicinity of a position where the intermediate transferring belt 15 butts against the photosensitive drum 11 in a wrapping manner. In other words, the photosensitive drum 11 is placed in a position which is closer to the secondary transfer station against which the secondary transferring roll 16 butts, than a position where the intermediate-transferring member cleaner 30 is disposed. As described above, the embodiment is an apparatus using the intermediate-transferring belt 15 which is rotated for each color, and employs a layout in which the secondary transfer station is disposed immediately after (relatively in the vicinity of) the primary transfer station where the intermediate transferring belt 15 and the photosensitive drum 11 butt against each other in a wrapping manner.

The image forming apparatus comprises as a sheet conveying system: the sheet-supply cassette 31 which houses various recording media such as the sheets P and OHP sheets; a feed roll 32 which takes out and feeds the sheets P from the sheet-supply cassette 31; a retard roll 33 which separates one by one the fed sheets P; and a registration roll 34 which sets the timing of transfer for the sheet P transported from the sheet-supply cassette 31 via the feed roll 32 and the like, and positions the sheet.

In the image forming apparatus to which the embodiment is applied, as shown in FIG. 2, a sheet conveying path 60 is disposed as a vertical sheet conveying path. The sheet conveying path 60 is configured by a conveyance guide which is not shown, and an outer wall of the toner recovery bottle 19 which has a box-like shape. In the embodiment, namely, one face of the sheet conveying path 60 which is disposed between the registration roll 34 and the secondary transfer station, and which conveys the sheet P from the lower side in a substantially vertical direction to the upper side is formed by the outer wall of the toner recovery bottle 19, and the other one face is configured by the conveyance guide which is not shown.

The image forming apparatus to which the embodiment is applied comprises the controlling portion 40 which controls the operations of the components of the image forming apparatus, and a position sensor 41 which is a reflection photosensor, and which is disposed in adjacent to the intermediate transferring belt 15 to detect a toner patch formed on the intermediate transferring belt 15. The position sensor 41 can detect the position of the intermediate transferring belt 15 by reading a patch formed in the longitudinal direction of the intermediate transferring belt 15. Specifically, the exposing operation is performed by a predetermined timing after the detection of the patch by the position sensor 41, thereby enabling positionings of Y, M, C, and K. Based on the output of the position sensor 41, the density of the toner image formed on the intermediate transferring belt 15, and, on the basis of the result of the detection, the density control of the controlling portion 40 may be performed.

Next, an image forming process using the image forming apparatus shown in FIG. 2 will be described. In the image forming apparatus shown in FIG. 2, an output request from an information processing apparatus, an image reading apparatus, or the like which is externally connected is received, and, based on instructions from the controlling portion 40, the image forming process is started. In the case of a full color print output, firsts, the developing device 14 is rotated so that the developing unit 50 for yellow (Y) is opposed to the photosensitive drum 11. In the formation of a yellow toner image, initially, the photosensitive drum 11 which is rotated in a clockwise direction is charged in a charge station that performs a charge forming process by the charging device 12, and thereafter exposure based on image information corresponding to yellow is performed in an exposure station by, for example, a laser beam from the exposing device 13 to form an electrostatic latent image. Then, a developing process is performed by the developing roll 51, and a toner image of yellow is transferred to the intermediate transferring belt 15 in a wrap-like contact range (wrap range) At this time, the secondary transferring roll 16, the scraper 25, and the brush roll 26 are separated (retracted) from the intermediate transferring belt 15, and these members do not scrape off the toner image on the intermediate transferring belt 15.

After the primary transfer, a toner remaining on the surface of the photosensitive drum 11 is scraped off by the cleaning blade 18, and the surface is moved to the charge station due to the charging device 12 for the next toner image formation. The residual toner which is scraped off by the cleaning blade 18 is collected in the toner recovery bottle 19. The developing device 14 is rotated so as to meet the timing of development, and the developing unit 50 for magenta is opposed to the photosensitive drum 11. Exposure based on image information corresponding to magenta is performed by the exposing device 13 to form an electrostatic latent image. From the latent image, a toner image of magenta is formed and then superimposed on the intermediate transferring belt 15. In the same manner, toner images of cyan and black are sequentially superimposed on the intermediate transferring belt 15, thereby ending the primary transfer.

In an inter-image region where the primary transfer for the toner image for cyan by the exposing device 13 is ended, and the toner image in which yellow, magenta, and cyan are superimposed is passed through the secondary transfer station (a place where the secondary transfer is performed by the secondary transferring roll 16), before exposure (black exposure) for forming a black electrostatic latent image is started, the secondary transferring roll 16 is pushed (advanced), and prepared for the secondary transfer in a state where the secondary transferring roll 16 butts (contacts) against the intermediate transferring belt 15. When a cleaner station (a place where cleaning is performed by the scraper 25 and the brush roll 26) is in the inter-image region after the black exposure is ended, the scraper 25 and the brush roll 26 are pushed out toward the intermediate transferring belt 15. It can be the that the inter-image region is a region of the intermediate transferring belt 15 and the photosensitive drum 11 where a toner image is not formed (the formation of a toner image is not scheduled), or a portion where writing due to exposure is not scheduled.

By contrast, the feed roll 32 is driven at a predetermined timing based on the control of the controlling portion 40, and the sheets P are sequentially taken out from the sheet-supply cassette 31, separated one by one by the retard roll 33, and reach the registration roll 34. The registration roll 34 functions so that it is rotated in synchronization with the timing of the secondary transfer in the secondary transfer station, and the sheet P is sent to the secondary transfer station at a predetermined timing. In the embodiment, as described above, the surface (outer wall) of the toner recovery bottle 19 is used as the sheet conveying path 60, and the sheet P is conveyed by using the sheet conveying path 60 in which the surface (outer wall) of the toner recovery bottle 19 and the conveyance guide that is not shown are used. In this way, the sheet P housed in the sheet-supply cassette 31 is conveyed in a substantially vertical direction by the conveying device, into the secondary transfer station due to the secondary transferring roll 16 and the backup roll 24, and the toner image is transferred to the sheet. This conveying path in the vertical direction enables the secondary transfer, and the sheet conveying path to be extremely shortened. Therefore, the number of parts can be reduced, the cost reduction due to the reduced number of conveying path is enabled, and the reliability of the sheet conveyance can be improved.

The sheet P onto which the toner image is transferred in the secondary transfer station is conveyed to the fixing device 90. In the fixing device 90, the sheet P is heated and pressurized so that the toner image is fixed, and then discharged. When discharged to the outside of the apparatus, the sheet P is housed in the discharge tray 38 disposed in the upper portion of the body 1. As described above, the image forming process of outputting one color print is ended. In the embodiment, with using the intermediate transferring belt 15 having the layout which extremely reduces the body 1, and which has a relatively thin and flat shape, the secondary transfer is performed by means of conveyance through the vertical path.

Next, the configurations of the photosensitive drum 11, the developing device 14, and the intermediate transferring belt 15 will be described in detail.

Figure 3:
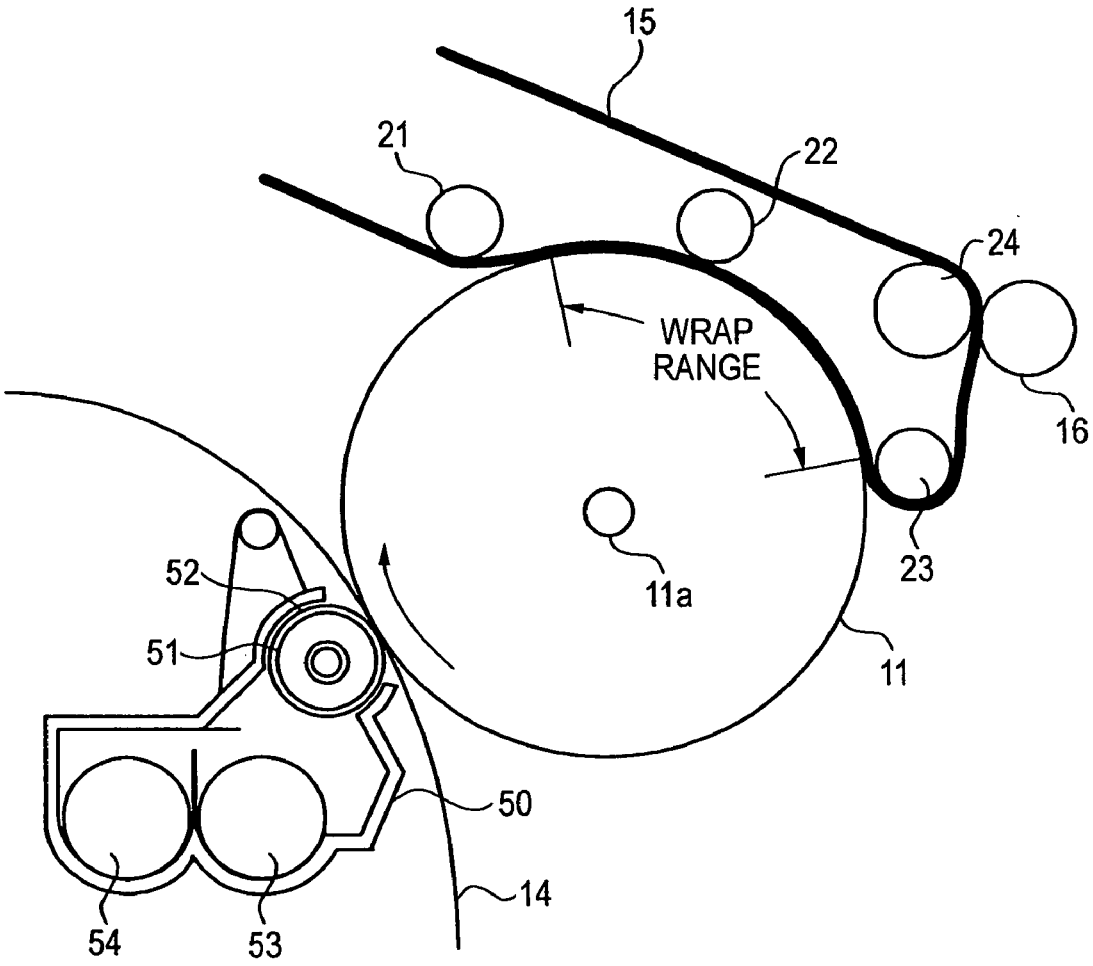
FIG. 3 is a view illustrating relationships among a photosensitive drum, a developing device, and an intermediate transferring belt.

FIG. 3 is a view illustrating relationships among the photosensitive drum 11, the developing device 14, and the intermediate transferring belt 15. The photosensitive drum 11 is configured by a pipe member having a diameter of about 47 mm. A photosensitive layer is formed on the surface of an aluminum pipe. The drum receives a driving force of a motor (not shown) from a shaft 11*a* in a center portion via aluminum flanges (not shown) disposed on the both ends of the aluminum pipe. In the case where a color image of a length in the vertical direction of A4 (297 mm) is printed out at the rate of 5 sheets per minute (5 ppm), 20 images of 4 colors×5 sheets must be formed for one minute on the photosensitive drum 11. The photosensitive drum 11 is configured so as to make three rotations for formation of one image, or to be rotated at about 150 mm/sec., i.e., make about one rotation per second. In order to reduce color misalignment due to eccentricity of the photosensitive drum 11 or the like, preferably, the image forming position on the photosensitive drum 11 is set to be uniform for each color.

Each of the developing units 50 of Y, M, C, and K constituting the developing device 14 comprises: the developing roll 51 which is a developer holder for holding the developer; the tracking roll 52 which is a positioning member for maintaining constant the distance between the developing roll 51 and the photosensitive drum 11; and a supply auger 53 and admix auger 54 which stir the developer to be supplied to the developing roll 51. The developing roll 51 is configured by, for example, a pipe member having a diameter of 16 mm. A magnet roll (not shown) disposed in the pipe member attracts carriers contained in the developer by a magnetic force to form a magnetic brush for the developer on the surface of the developing roll 51. The toner adsorbed to the carrier is conveyed to the developing region of the photosensitive drum 11. The thus formed magnetic brush performs the developing process while its tips are in contact with the surface of the photosensitive drum 11. Therefore, the distance between the photosensitive drum 11 and the developing roll 51 must be always maintained to a certain constant value.

In both end portions (the In and Out sides of the apparatus, or the right and left sides of the apparatus) of the developing roll 51, therefore, the tracking roll 52 having a radius which is larger by a small degree (about 0.3 mm) than that of the developing roll 51 is disposed coaxially with the developing roll 51. When the developing roll 51 has a diameter of 16 mm, for example, the diameter of the tracking roll 52 is 16.6 mm. The tracking roll 52 is made of a synthetic resin such as polyacetal, and disposed in each of the four developing units 50 in the developing device 14. In switching of the developing units 50, the developing device 14 is rotated by 90 degrees for 0.7 sec. to oppose the desired one of the developing units 50 to the photosensitive drum 11. At this time, the tracking roll 52 butts against the photosensitive drum 11 while drawing a locus on the circumference, and by an impact force while reducing the impact by a predetermined elastic force of the coil spring 55 shown in FIG. 2.

By contrast, the intermediate transferring belt 15 is caused to be in contact with the wrap range (wrap-like contact range) by the wrap-in roll 21 and the wrap-out roll 23 so as to cover the photosensitive drum 11. The wrap-in roll 21 and the wrap-out roll 23 are not in contact with the photosensitive drum 11, and prevent catching of the intermediate transferring belt 15 due to wobbling of the photosensitive drum 11 from occurring, thereby suppressing a damage of the intermediate transferring belt 15. The wrap range is an arcuate range which is formed on the periphery of the photosensitive drum 11 by an angle of about 90 degree. The intermediate transferring belt 15 is an elastic belt, and presses the photosensitive drum 11 by a relatively large load. Particularly, the embodiment is configured so that a driving force is not applied to the intermediate transferring belt 15 itself, and the intermediate transferring belt 15 receives the drive of the photosensitive drum 11 to be driven thereby.

Figure 4:
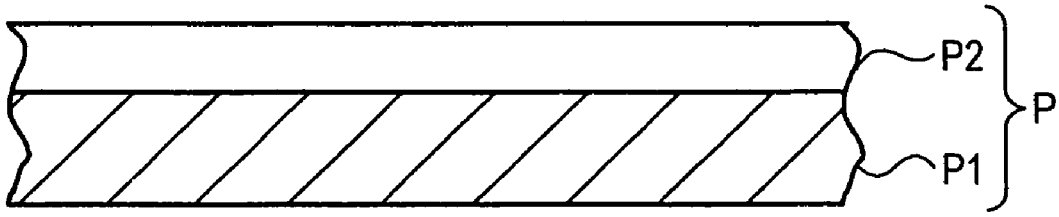
FIG. 4 is a schematic section view illustrating a sheet.

FIG. 4 is a schematic section view illustrating the sheet P.

In the sheet P, as shown in FIG. 4, a transparent resin P2 essentially comprising a thermoplastic resin is stacked on the base material P1. Examples of the base material P1 are plain paper for image formation, coated paper, and photographic paper. Examples of the thermoplastic resin constituting the layer of the transparent resin P2 are a polyethylene resin and a styrene-acrylic ester resin. Preferably, the layer of the transparent resin P2 has a thickness into which a toner image can be fused and embedded by the heat and the pressure in fixation. The sheet P is not particularly restricted as far as it is a recording medium which can be used in the image forming apparatus. From the viewpoint that a photographic-like image of high glossiness is obtained by the fixing device 90, it is preferable to use the sheet P shown in FIG. 4.

Figure 5:
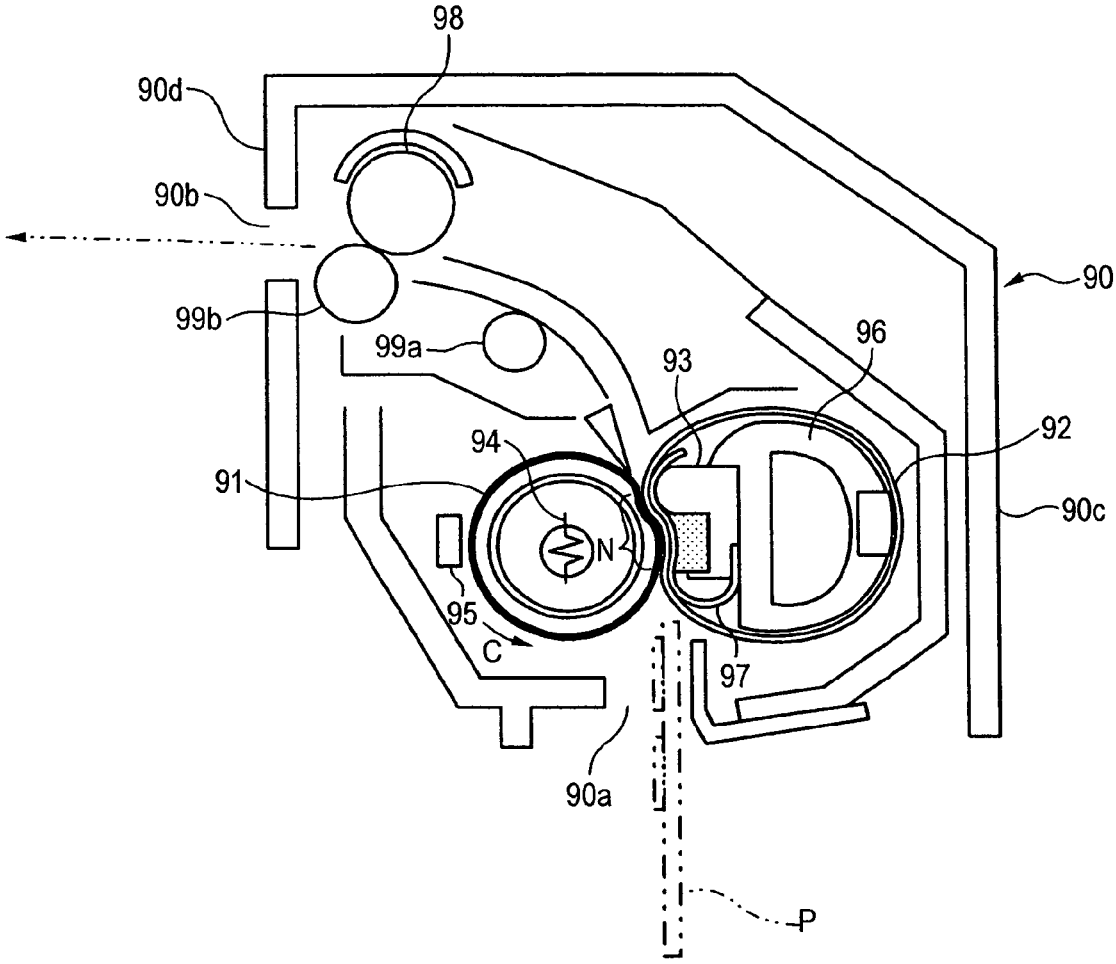
FIG. 5 is a side section view showing the configuration of the fixing device.

FIG. 5 is a side section view showing the configuration of the fixing device 90.

In the fixing device 90, as shown in FIG. 5, the main portion is configured by: a fixing roll 91 which is positioned on the upstream side of the sheet conveyance; a pressurizing belt 92 which is opposed to the fixing roll 91; and a pressure pad 93 which is positioned on the inner circumferential face of the pressurizing belt 92, and which is pressed by the fixing roll 91 via the pressurizing belt 92

The fixing roll 91 is a cylindrical roll which is configured by stacking a heat-resistant elastic layer and a releasing layer on the circumference of a metal core (cylindrical metal core), which is rotatably supported, and which is rotated at a predetermined surface velocity. In the fixing roll 91, a halogen heater 94 having a rating of, for example, 600 W is disposed as a heating source. On the other hand, a temperature sensor 95 is placed on the surface of the fixing roll 91. The controlling portion 40 (see FIG. 2) of the image forming apparatus controls the on/off states of the halogen heater 94 on the basis of the temperature measurement value of the temperature sensor 95, to adjust the surface temperature of the fixing roll 91 to be maintained to a preset temperature (for example, 175° C.).

The pressurizing belt 92 is a seamless endless belt, and rotatably supported by: a pressure pad 93 which is placed inside the pressurizing belt 92; a guide member 96; and belt restricting members which are not shown, and which are placed on both end portions of the pressurizing belt 92. The pressurizing belt is placed so as to be pressurized against the fixing roll 91 in a nip portion N, and drivenly rotated by the fixing roll 91.

In the pressure pad 93, in order to reduce the sliding resistance between the inner circumferential face of the pressurizing belt 92 and the pressure pad 93, a slide holding sheet or a low-friction sheet 97 is disposed on the face contacting with the pressurizing belt 92. In the low-friction sheet 97, an end portion of the upstream side of the nip portion N is fixed to the guide member 96, and the other end portion on the downstream side of the nip portion N is not fixed or is set to a free-end state so that the low-friction sheet 97 is not distorted.

In the fixing device 90, a discharge roll and pinch rolls 99*a*, 99*b* are disposed in order to discharge the sheet P onto which the toner image is fixed. The discharge roll 98 and the pinch roll 99*b* are placed in the vicinity of a sheet outlet 90*b* and opposed to each other. The pinch rolls 99*a*, 99*b* are placed while forming a predetermined gap in the axial direction (a direction perpendicular to the plane of the paper).

In this configuration, the fixing roll 91 is coupled to a driving motor which is not shown to be rotated in the direction of the arrow C. The pressurizing belt 92 is driven by the rotation to be rotated in the same direction as the fixing roll 91.

In the secondary transfer station of the image forming apparatus, the sheet P onto which the toner image is electrostatically transferred is conveyed from a sheet inlet 90*a* to the nip portion N. When the sheet 2 is passed through the nip portion N, the toner image on the sheet P is fixed by the pressure acting on the nip portion N, and the heat supplied from the fixing roll 91. After passed through the nip portion N, the sheet P is conveyed to the sheet outlet 90*b* via the pinch roll 99*a*, and discharged to the outside of the device by the discharge roll 98 and the pinch roll 99*b*. The sheet P discharged from the fixing device 90 is stacked on the discharge tray 38 disposed in the upper portion.

(In the Case where the Fixing Device 70 is Attached to the Body 1)

Figure 6:
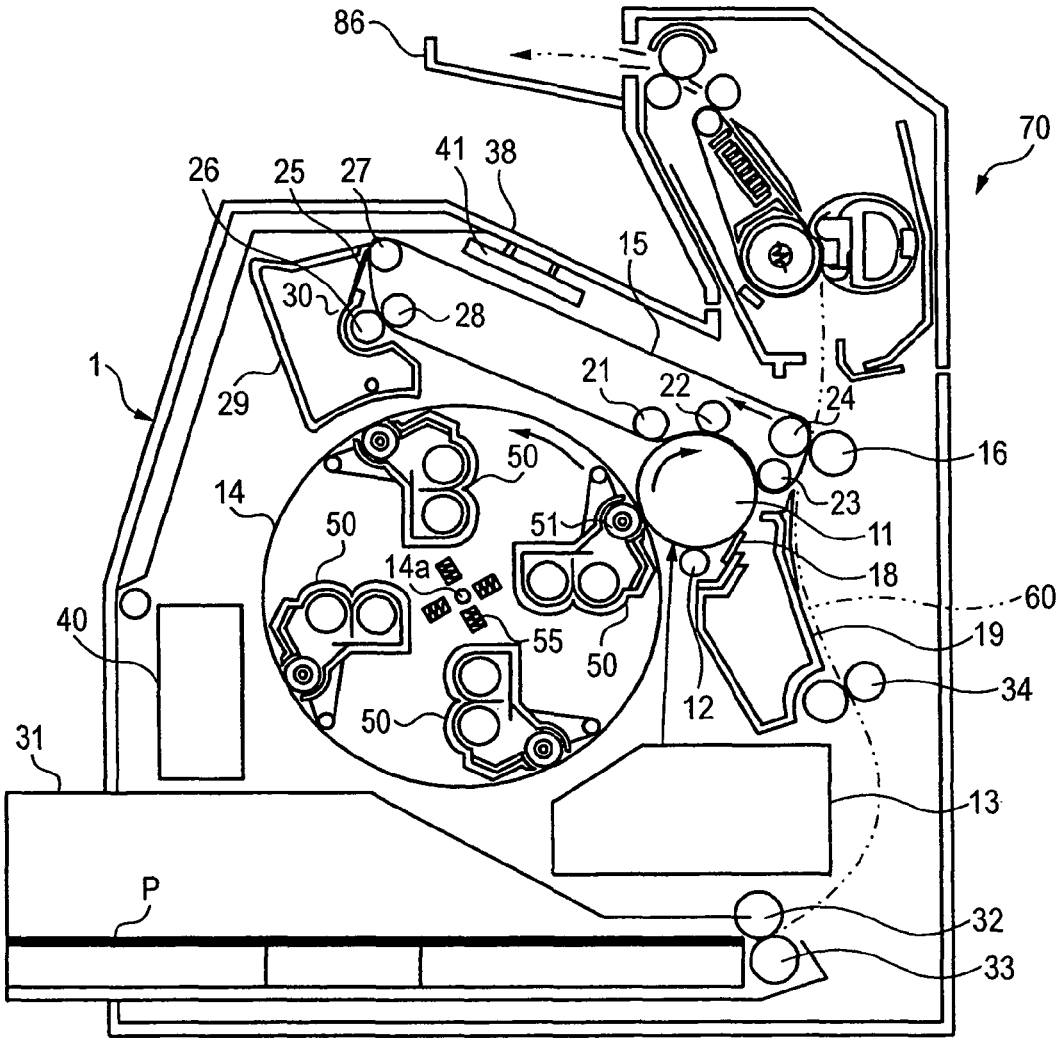
FIG. 6 is a view showing a state where the fixing device is attached to the body of the image forming apparatus.

Next, the configuration shown in FIG. 1B will be described. FIG. 6 is a view showing a state where the fixing device 70 is attached to the body 1 of the image forming apparatus.

When the fixing device 70 is attached to the body 1, as shown in FIG. 6, a housing tray 86 is further disposed above the discharge tray 38. The housing tray 86 is detachably attached to the fixing device 70.

The body 1 shown in FIG. 6 is identical in configuration and function with the body 1 shown in FIG. 2, and hence its description is omitted.

Figure 7:
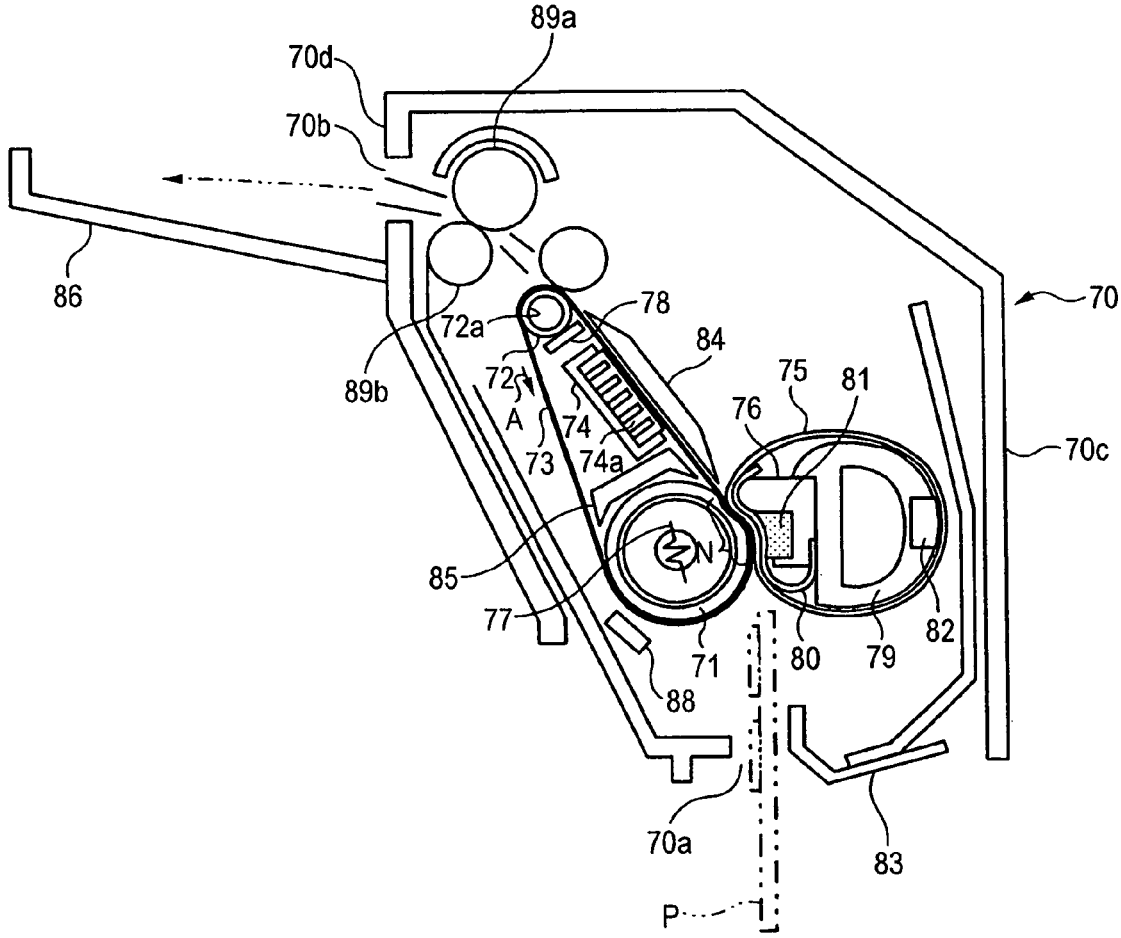
FIG. 7 is a side section view showing the configuration of the fixing device.

FIG. 7 is a side section view showing the configuration of the fixing device 70.

In the fixing device 70, as shown in FIG. 7, the main portion is configured by: a heating roll (a fixing roll and a rotation member) 71 which is positioned on the upstream side of the sheet conveyance; a separation roll 72 which is positioned on the downstream side of the sheet conveyance; a fixing belt 73 which is looped around the heating roll 71 and the separation roll 72; a cooling device (cooling portion) 74 which is positioned in a space surrounded by the fixing belt 73, and between the heating roll 71 and the separation roll 72; a pressurizing belt 75 which is opposed to the fixing roll 71; and a pressure pad 76 which is positioned on the inner circumferential face of the pressurizing belt 75, and which is pressed by the heating roll 71 via the pressurizing belt 75. The heating roll 71, the fixing belt 73, the pressurizing belt 75, and the pressure pad 76 constitute a fusion-bonding portion. An air blowing portion 87 (see FIG. 8) which will be described later releases heat of the cooling device 74.

The heating roll 71 is a cylindrical roll which is rotatably supported, and which is rotated at a predetermined surface velocity. In the heating roll 71, a halogen heater 77 having a rating of, for example, 600 W is disposed as a heating source. The toner image formed on the sheet P is heated by the heat of the halogen heater 77. On the other hand, a temperature sensor 78 is placed contactingly with the surface of the separation roll 72.

The separation roll 72 is a roll which causes the fixing belt 73 to be stretched with a predetermined curvature, thereby promoting the peeling of the sheet P which is conveyed in a state where it is in contact with the fixing belt 73. The separation roll 72 is a cylindrical member having an internal space (ventilation duct) 72*a*, and made of a metal material such as aluminum, or SUS (stainless steel). The separation roll 72 is rotatably supported by a support frame which is not shown, and elastically urged in a direction along which a tension is applied to the fixing belt 73, by a known tension applying mechanism configured a spring and the like.

The fixing belt 73 is a seamless endless belt configured by a belt base member having a thickness of about 30 to 200 μm, and an elastic releasing layer which is formed on the outer circumferential face side of the belt base member, and which has a thickness of about 10 to 200 μm. The belt base member is formed by a heat-resistant resin such as polyimide or polyamide, or a metal material such as nickel or aluminum, and the elastic releasing layer is formed by silicone rubber or fluoro rubber.

Preferably, the outer circumferential face (specifically, the surface of the elastic releasing layer) of the fixing belt 73 is a surface as smooth as possible (similar to a mirror surface). The fixing belt 73 is looped between the heating roll 71 and the separation roll 72, and caused to rotationally travel by the rotation of the heating roll 71.

More specifically, a sheet guide 84 is placed so as to be opposed to the fixing belt 73 between the heating roll 71 and the separation roll 72. The sheet P which is conveyed in a state where it is in close contact with the fixing belt 73 advances between the fixing belt 73 and the sheet guide 84. Preferably, the toner image which is fuse-bonded onto the sheet P in the fusion-bonding portion is cooled in the state where the toner image and the sheet P remains to be in close contact with the fixing belt 73. In other words, when the toner image and the sheet P are peeled off or deviated from the fixing belt 73 before the fuse-bonded toner image is cooled to a reduced temperature, the high-quality image output is disturbed, and therefore this is not preferable. In order to obtain a high-quality image, consequently, it is preferable that an unwanted or irregular external force is hardly transmitted between the image surface and the fixing belt 73 until the fuse-bonded toner image is cooled. Preferably, the sheet P is conveyed while maintaining a given posture (for example, conveyed under a substantially linear shape or a constant curvature), thereby causing the sheet P to, between the heating roll 71 and the separation roll 72, be conveyed in the state where it is in close contact with the fixing belt 73 between the fixing belt 73 and the sheet guide 84. From the point of view that an unwanted or irregular external force is suppressed, it is preferable to convey the sheet P while the image surface is in contact with the fixing belt 73 with downwardly directing the surface, and the sheet guide 84 is placed above the rear face that is opposite to the image surface.

A temperature sensor 88 is disposed in the vicinity of the portion of the fixing belt 73 which is wound around the heating roll 71. The temperature sensor 8 is used for detecting the surface temperature of the fixing belt 73.

The cooling device 74 forcibly cools the inner circumferential portion of the fixing belt 73 which extends from the heating roll 71 to the separation roll 72. In the device, plural fins 74*a* are formed so as to extend in the width direction of the fixing belt 73.

The pressurizing belt 75 is a seamless endless belt, and rotatably supported by: a pressure pad 76 which is placed inside the pressurizing belt 75; a guide member 79; and belt restricting members which are not shown, and which are placed on both end portions of the pressurizing belt 75. The pressurizing belt is placed so as to be pressed against the heating roll 71 in a nip portion N, and drivenly rotated by the fixing belt 73.

In a region of the pressurizing belt 75 except the both end portions in the width directions the pressurizing belt 75 is supported by the pressure pad 76 and the guide member 79. In the region of the pressurizing belt 75 except the both end portions, the inner circumferential face of the pressurizing belt 75 is rotated while being in sliding contact with a slide holding sheet 80 which is an example of a sliding contact member placed so as to cover the pressure pad 76 and the guide member 79, and also with the guide member 79.

The pressure pad 76 is supported by the guide member 79 inside the pressurizing belt 75, and placed in a state where it is pressed against the heating roll 71 via the pressurizing belt 75, to cooperate with the fixing belt 73 to form the nip portion N. A soft pad 81 for ensuring a wide nip portion N is placed on the pressure pad 76 and on the inlet side of the nip portion N. In the outlet side (downstream side) of the nip portion N, the pressure pad 76 locally presses the surface of the heating roll 71, whereby the surface of the toner image is smoothed to provide the image with gloss.

In the pressure pad 76, in order to reduce the sliding resistance between the inner circumferential face of the pressurizing belt 75 and the pressure pad 76, the slide holding sheet 80 is disposed on the face contacting with the pressurizing belt 75. The slide holding sheet 80 is disposed in a state where it is pressingly held between the pressure pad 76 and the inner circumferential face of the pressurizing belt 75, in the whole area of the nip portion N.

In the guide member 79, a lubricant impregnated member (oil impregnated felt) 82 is disposed over the longitudinal direction of the fixing device 70. The lubricant impregnated member 82 is placed so as to be in contact with the inner circumferential face of the pressurizing belt 75 to supply an adequate amount of lubricant. According to the configuration, the lubricant is supplied to the sliding portion between the pressurizing belt 75 and the slide holding sheet 80 to further reduce the sliding resistance between the pressurizing belt 75 and the pressure pad 76 through the slide holding sheet 80, thereby enabling the pressurizing belt 75 to be smoothly rotated. The supply of the lubricant has another effect that wears of the inner circumferential face of the pressurizing belt 75 and the surface of the slide holding sheet 80 are suppressed.

A heat insulating member 85 which extends along the outer circumferential face of the heating roll 71 is placed between the heating roll 71 and the cooling device 74. The heat insulating member 85 is placed so as to partition the space between the heating roll 71 and the cooling device 74. In order to prevent the heat of the heating roll 71 from being transmitted to the cooling device 74, therefore, the insulating member 85 performs heat insulation between them. The heat insulating member 85 further prevents a wind passing over the fins

74*a* from hitting the heating roll 71. The heat insulating member 85 is attached to a frame which is not shown FIG. 8 is a diagram illustrating the ventilation in the fixing device 70.

Figure 8:
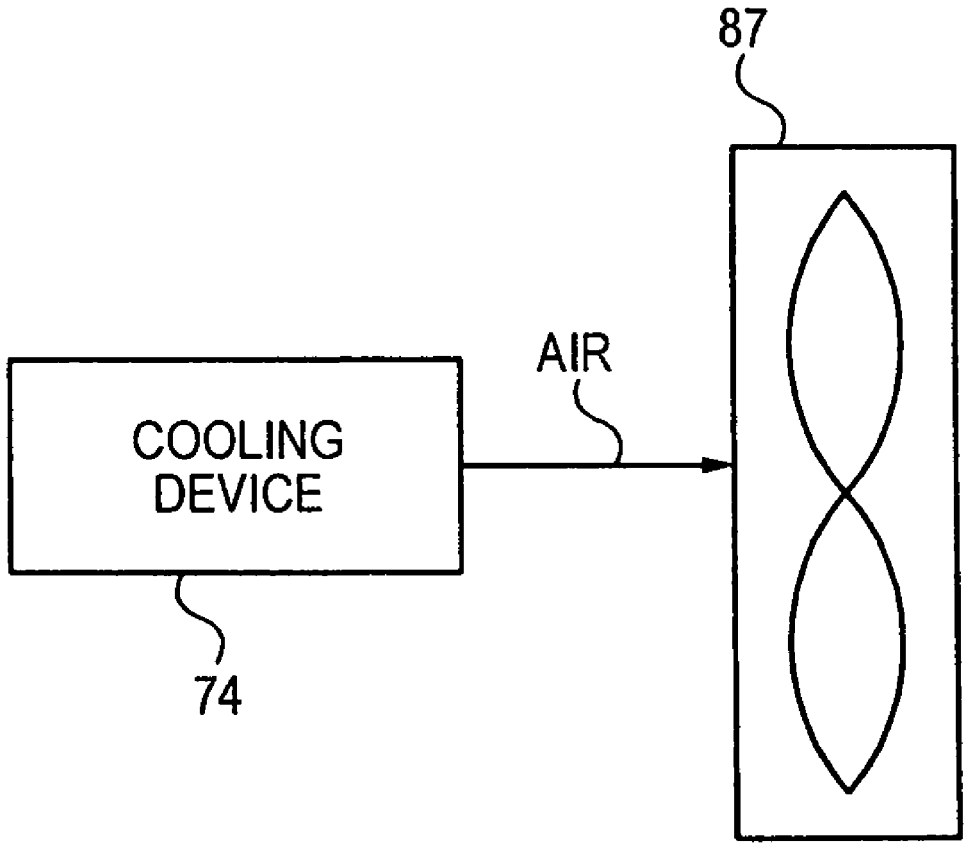
FIG. 8 is a diagram illustrating ventilation in the fixing device.

As shown in FIG. 8, the fixing device 70 comprises the air blowing portion (a heat-releasing portion, and a fan) 87. The air passing over the fins 74*a* (see FIG. 7) of the cooling device 74 is exhausted by the air blowing portion 87 to the outside of the fixing device 70. In accordance with the exhaustion of the air, the heat of the cooling device 74 is released to the outside of the fixing device 70. Alternatively, a configuration where the air in the internal space 72*a* (see FIG. 7) which has a cylindrical shape in the separation roll 72 is exhausted by the air blowing portion 87 to the outside of the fixing device 70.

Figure 9:
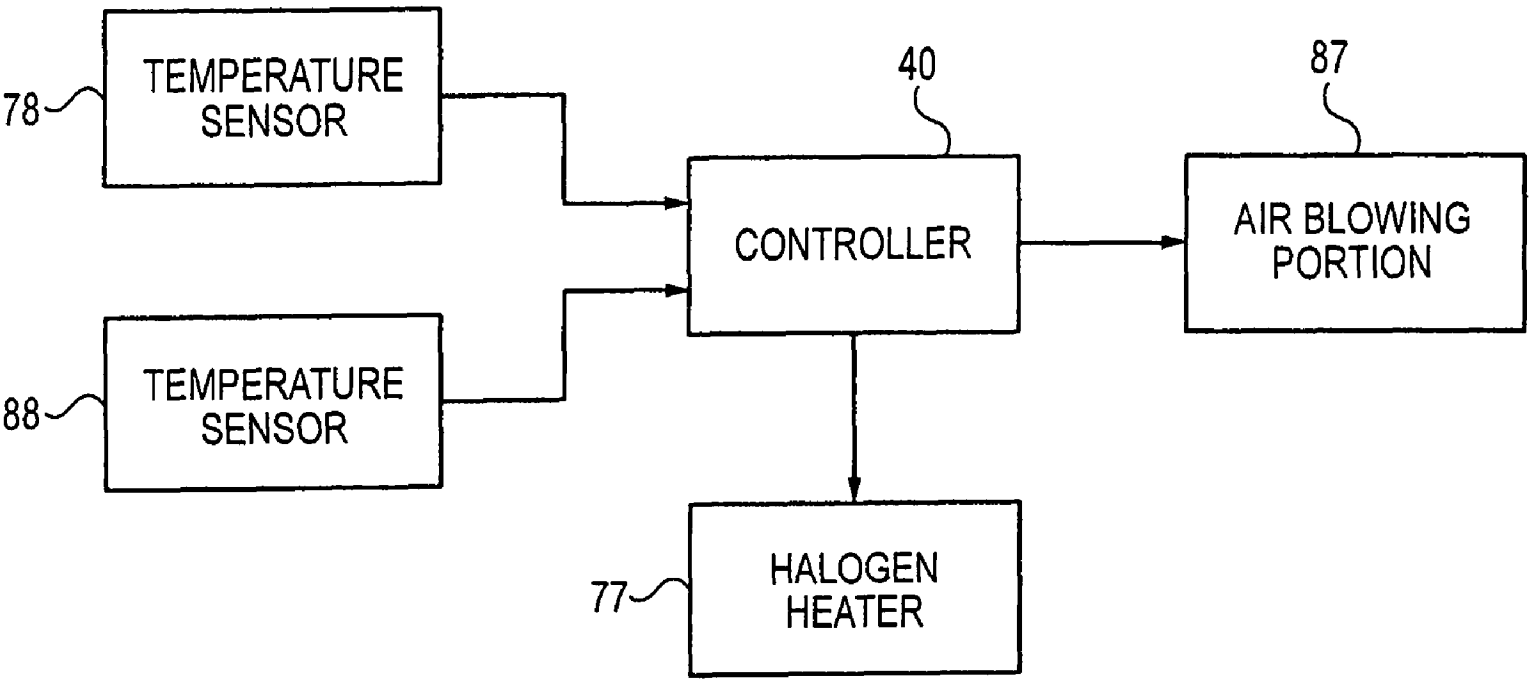
FIG. 9 is a block diagram illustrating the control of a controlling portion.

FIG. 9 is a block diagram illustrating the control of the controlling portion 40.

As shown in FIG. 7, the temperature sensor 78 is placed on the surface of the separation roll 72 (see FIG. 7), and outputs the detected temperature to the controlling portion 40. The temperature sensor 88 is placed in the vicinity of the fixing belt 73, and outputs the detected temperature to the controlling portion 40. In accordance with the detection results from the temperature sensors 78, 88, the controlling portion 40 controls the halogen heater 77 and the air blowing portion 87. Namely, based on the temperature measured value of the temperature sensor 78, the controlling portion 40 controls the air blowing portion 87 so that the temperature of the separation roll 72 (see FIG. 7) is maintained to a preset temperature (for example, 40° C.). By this control of the air blowing portion 87, also the cooling device 74 is maintained to a preset temperature together with the separation roll 72 (see FIG. 7).

Furthermore, based on the temperature measured value of the temperature sensor 88, the controlling portion 40 controls the on/off states of the halogen heater 77 so that the surface temperature of the fixing belt 73 (see FIG. 7) is maintained to a preset temperature (for example, 175° C.).

Next, returning to FIG. 7, the operation of the fixing device 70 will be described. At the timing of the fixing operation, the heating roll 71 starts to be rotated so as to cause the fixing belt 73 to rotationally travel in the direction of the arrow A, and the halogen heater 77 is energized to generate heat to heat the heating roll 71 to the predetermined fixing temperature and maintain it. At this time, in accordance with the rotation of the heating roll 71, the pressurizing belt 75 is driven through the fixing belt 73, and starts to be rotated. The air blowing portion 87 (see FIG. 8 or 9) for air cooling the separation roll 72 and the cooling device 74 begins to operate before the fixing operation is started. In this way, the nip portion N enters a state where it is heated to the predetermined fixing temperature, and the fixing belt 73 is in a state where it is forcibly cooled by the cooling device 74.

In the fixing device 70, thereafter, the sheet P onto which a toner image formed in accordance with image information is transferred in the side of the image forming apparatus is sent from a sheet inlet 70*a* to the nip portion N via a fixation inlet guide 83. When the sheet P is passed through the nip portion N, the toner image on the sheet P is fused by the pressure acting on the nip portion N, and the heat supplied from the fixing belt 73, and embedded into the sheet P. The sheet P to which the toner image is fixed is conveyed in accordance with the rotation of the fixing belt 73 in the state where the sheet butts (closely contacts) against the outer circumferential face of the fixing belt 73 also after the sheet is passed through the nip portion N.

When the sheet P is conveyed in the state where the sheet butts against the fixing belt 73, the sheet is cooled by the cooling device 74. Namely, the heat of the sheet P which has been passed through the nip portion N is transmitted and released to the fixing belt 73 which is cooled by the cooling device 74. In this case, the fins 74*a* of the cooling device 74 are air-blown by the air blowing portion 87 (see FIG. 8 or 9), and the insulating member 85 prevents the heat of the heating roll 71 from being transmitted to the cooling device 74. Therefore, heat is efficiently released in the cooling device 74. The toner image and the sheet P are cooled and approximately hardened in state where the toner image is embedded into the sheet P.

The cooled sheet P in the state where it butts against the fixing belt 73 is conveyed to the separation roll 72. Because the rotation state having the curvature of the fixing belt 73 wound around the separation roll 72 conflicts with the stiffness of the sheet P itself, the sheet is spontaneously separated from the fixing belt 73 wound around the separation roll 72, whereby the fixation is ended. Thereafter, the sheet P separated from the fixing belt 73 is discharged from a sheet outlet 70*b* by the functions of a discharge roll 89*a* (see FIG. 7) and a pinch roll 89*b* (see FIG. 7) and sent to the housing tray 86 located above the discharge tray 38.

When the fixation by the fixing device 70 is normally performed, particularly the cooling in the cooling region is performed evenly and uniformly. As a result, the toner image is fixed so as to attain a state where it is uniformly embedded into the sheet P, and that where the surface of the sheet after fixation exhibits excellent smoothness with following the smooth surface of the fixing belt 73. Namely, the image on the sheet P after fixation is obtained as a high-quality image which produces less irregular reflection due to surface roughness, which exhibits high glossy, and which is similar to a photographic image.

The length of the sheet path extending from the sheet inlet 70*a* of the fixing device 70 shown in FIG. 7 to the sheet outlet 70*b* is larger than that of the sheet path extending from the sheet inlet 90*a* of the fixing device 90 shown in FIG. 5 to the sheet outlet 90*b*.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an apparatus body;

an image forming unit that forms a toner image, and that transfers the toner image to a sheet;

a first fixing device that fixes the toner image transferred to the sheet by the image forming unit; and a second fixing device that has a sheet-path length being longer than the first fixing device, and that outputs an image of a higher quality than produced by the first fixing device, the first and second fixing device being selectively attached, and the apparatus body including:

a first attaching region that is formed by detaching the first fixing device;

a sheet-discharging region in which, in a case where the first fixing device is attached to the apparatus body, a sheet subjected to a fixing operation by the first fixing device is discharged while downwardly directing a face on which the fixing operation is performed, and that is positioned in an upper portion of the apparatus body; and a second attaching region to which the second fixing device is attached, and that includes the first attaching region and the sheet-discharging region.

2. The image forming apparatus as claimed in claim 1, further comprising:

a storing unit that is disposed drawably from the apparatus body, and that stores a sheet conveyed to the image forming unit, wherein the first attaching region is provided in a position on a side of the apparatus body from which the storing portion is drawn out.

3. The image forming apparatus as claimed in claim 1, wherein the second fixing device comprises a sheet outlet positioned further in a sheet-discharging direction than a sheet outlet in a case where the first fixing device is attached to the first attaching region.

4. The image forming apparatus as claimed in claim 1, further comprising:

a detecting unit that detects whether the first fixing device is attached to the first attaching region or whether the second fixing device is attached to the first attaching region in place of the first fixing device.

5. The image forming apparatus as claimed in claim 1, wherein the apparatus body comprises:

an outer face;

a part of the outer face including one of outer faces of the first; and second fixing device, and the outer face of the first fixing device in a case where the first fixing device is attached to the first attaching region, and the outer face of the second fixing device in a case where the second fixing device is attached to the second attaching region are located in a same position.

6. The image forming apparatus as claimed in claim 5, further comprising:

a storing unit that is disposed drawably from the apparatus body, and that stores a sheet conveyed to the image forming unit, wherein the first attaching region is positioned in a position on a side of the apparatus body from which the storing unit is drawn out.

7. The image forming apparatus as claimed in claim 5, wherein the second fixing device comprises a sheet outlet, and the sheet outlet in a case where the second fixing device is attached to the second attaching region is positioned further in a sheet-discharging direction than a sheet outlet in the case where the first fixing device is attached to the first attaching region.

* * * * *